US008132894B2

(12) United States Patent
Lee

(10) Patent No.: US 8,132,894 B2
(45) Date of Patent: Mar. 13, 2012

(54) METHOD AND INKJET PRINTING APPARATUS EJECTING INK IN DEFLECTED FASHION

(75) Inventor: You-Seop Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 491 days.

(21) Appl. No.: 12/398,333

(22) Filed: Mar. 5, 2009

(65) Prior Publication Data

US 2010/0039476 A1 Feb. 18, 2010

(30) Foreign Application Priority Data

Aug. 18, 2008 (KR) ..... 10-2008-0080564

(51) Int. Cl.
*B41J 2/04* (2006.01)

(52) U.S. Cl. ..... 347/54; 347/55

(58) Field of Classification Search ..... 347/20, 347/48, 54, 55, 62, 70–71, 74, 77
See application file for complete search history.

(56) References Cited

U.S. PATENT DOCUMENTS

| | | | | |
|---|---|---|---|---|
| 4,752,783 | A | 6/1988 | Saito et al. | |
| 6,509,917 | B1 * | 1/2003 | Chwalek et al. | 347/82 |
| 6,517,197 | B2 | 2/2003 | Hawkins et al. | |
| 6,837,574 | B2 | 1/2005 | Yamada et al. | |

* cited by examiner

*Primary Examiner* — Juanita D Jackson
(74) *Attorney, Agent, or Firm* — Staas & Halsey LLP

(57) ABSTRACT

A method and an inkjet printing apparatus for ejecting ink in a deflected manner are provided. The inkjet printing apparatus includes an inkjet printhead having a passage plate, an electrostatic-force-application unit, and a heating unit. The passage plate includes ink chambers that hold ink and nozzles that eject the ink from the ink chambers as ink droplets. The electrostatic-force-application unit applies an electrostatic force. The heating unit heats up a portion of the ink inside the nozzles. The heating unit can include heaters disposed around each nozzles or a laser diode disposed outside the inkjet printhead. The electrostatic force forms a meniscus at the surface of the ink inside the nozzle. When a portion of the ink inside the nozzle is heated by the heating unit, the shape of the meniscus is changed and the direction in which the ink droplets are ejected through the nozzles is deflected.

20 Claims, 9 Drawing Sheets

METHOD AND INKJET PRINTING APPARATUS EJECTING INK IN DEFLECTED FASHION

CROSS-REFERENCE TO RELATED PATENT APPLICATION

This application claims the benefit of Korean Patent Application No. 10-2008-0080564, filed on Aug. 18, 2008 in the Korean Intellectual Property Office, the disclosure of which is incorporated herein by reference in its entirety.

TECHNICAL FIELD

Embodiments are generally related to inkjet printing apparatus, and more particularly, to a method of ejecting ink droplets in a deflected manner and an inkjet printing apparatus capable of performing the method.

BACKGROUND OF RELATED ART

Generally, a drop-on-demand inkjet printing apparatus has an inkjet printhead that is used to eject fine droplets of printing ink for printing an image on a printing medium such as, for example, a printing paper. The inkjet printing apparatus is capable of printing an image having one or more predetermined colors on a surface of the printing paper. The inkjet printhead can use various ink ejection methods such as an electrostatic driving method, a thermal driving method, or a piezoelectric driving method, for example.

The inkjet printhead includes multiple ink chambers containing ink and multiple nozzles for ejecting the ink. The multiple ink chambers and the multiple nozzles can be arranged in one or more rows. The inkjet printhead can include a driving unit and a driving circuit. The driving unit can be any of the following examples: an electrode configured to apply an electrostatic force, a heater configured to heat ink and produce ink bubbles, or a piezoelectric actuator. The driving circuit can be configured to control the operation of the driving unit.

In some instances, the ink droplets may not be ejected through one or more of the nozzles for various reasons such as blocking of a nozzle, damage to the driving unit, and/or damage to the driving circuit. As a result, one or more nozzles can be unavailable during printing and having a nozzle or nozzles missing can reduce the quality of the image printed on the printing paper. For example, when a nozzle is unavailable or missing during printing for any one of the reasons described above, an inkjet printhead having substantially the same width as a printing paper such that the inkjet printhead can print an image on the printing paper without the inkjet printhead having to scan back and forth across the width of the printing paper, white bands corresponding to the missing nozzles are typically present on the printed image.

SUMMARY OF THE DISCLOSURE

According to an aspect of the present disclosure, there is provided an inkjet printing apparatus having an inkjet printhead including a passage plate and multiple ink chambers defined within the passage plate. The passage plate has a surface and multiple nozzles on that surface. Each ink chamber is associated with one of the nozzles. The inkjet printing apparatus also includes an electrostatic-force-application unit that is configured to eject ink droplets from each of the nozzles by applying an electrostatic force to the ink inside the nozzles. The inkjet printing apparatus further includes a heating unit that is configured to heat a portion of the ink inside any one of the nozzles to deflect a direction in which the ink droplets are ejected from the nozzle to which the heat is applied.

The inkjet printing apparatus can include multiple ejection heaters. Each ejection heater can be configured to heat ink inside an associated ink chamber to generate bubbles that are used to eject ink droplets from the nozzle associated with that ink chamber. Each ejection heater can be disposed on a bottom surface of the associated ink chamber.

The inkjet printing apparatus can include multiple piezoelectric actuators. Each piezoelectric actuator can be configured to apply a pressure to ink inside an associated ink chamber to eject ink droplets from the nozzle associated with that ink chamber. The surface of the passage plate can be a first surface and the passage plate can have a second surface such that the piezoelectric actuators are disposed on the second surface of the passage plate. The passage plate can include a silicon substrate.

The electrostatic-force-application unit can include multiple first electrodes and a second electrode. The first electrodes can be disposed on the passage plate and one or more of the first electrodes can be associated with each nozzle. The second electrode can be offset from the surface of the passage plate by a predetermined distance. The first electrodes can be disposed on the surface of the passage plate. One or more of the first electrodes can be disposed around each of the nozzles. The surface of the passage plate can be a first surface and the passage plate can have a second surface such that the first electrodes can be disposed on the second surface of the passage plate.

The heating unit can include two or more deflection heaters associated with each of the nozzles and disposed around the associated nozzle. The two or more deflection heaters can be disposed on the surface of the passage plate and have an arc-like shape. The two or more deflection heaters can be disposed on an inner surface of the associated nozzle.

The heating unit can include a laser diode disposed outside the inkjet printhead and configured to produce an infrared laser beam directed at a portion of the ink inside any one of the nozzles. The heating unit can also include a scanner that is configured to direct the infrared laser beam produced by the laser diode to the portion of the ink inside any one of the nozzles.

According to another aspect, there is provided a method of ejecting ink droplets comprising applying an electrostatic force to ink inside one or more nozzles from a plurality of nozzles in an inkjet printhead, the electrostatic force producing a meniscus at a surface of the ink inside the one or more nozzles. A surface tension of the ink inside the one or more nozzles to which the electrostatic force is applied may be varied, the surface tension being varied by applying heat to a portion of the ink inside any one of the nozzles to which the electrostatic force is applied. The meniscus in the nozzle to which heat is applied is deformed by the variation in surface tension that results from the heating and the meniscus deformation is such that ink droplets ejected from that nozzle are deflected.

The meniscus at the surface of the ink inside the one or more nozzles has a taylor-cone shape, and the taylor-cone shape of the meniscus of the nozzle to which heat is applied is inclined by a Marangoni convection that results from the heating.

The meniscus of the nozzle to which heat is applied is sloped down in the direction of the heated portion of the ink, and the ink droplets ejected from that nozzle are deflected in the direction of the heated portion of the ink.

A temperature difference in the ink inside the nozzle to which heat is applied between the portion of the ink to which heat is applied and a portion of the ink to which heat is not applied is 10° C. or greater.

The portion of the ink inside the nozzle to which heat is applied is heated by a heater or by a laser diode emitting an infrared laser beam. The infrared laser beam emitted by the laser diode can be scanned to a position within the nozzle to which heat is applied.

According to another aspect of the invention, there is provided an apparatus including a substrate having an ink chamber and a nozzle, the ink chamber is defined within the substrate and configured to hold ink, the nozzle configured to eject ink from the ink chamber. The apparatus can include a first unit that is configured to produce an electrostatic force and a second unit that is configured to change a surface tension of a surface of the ink inside the nozzle. The first unit and the second unit can be collectively configured to direct ink droplets ejected from the nozzle in a direction offset from a direction perpendicular to a top surface of the substrate.

BRIEF DESCRIPTION OF THE DRAWINGS

Various aspects of the present disclosure will become more apparent and more readily appreciated from the following description of the embodiments liken in conjunction with the accompanying drawings, of which.

DETAILED DESCRIPTION OF SEVERAL EMBODIMENTS

Figure 1:
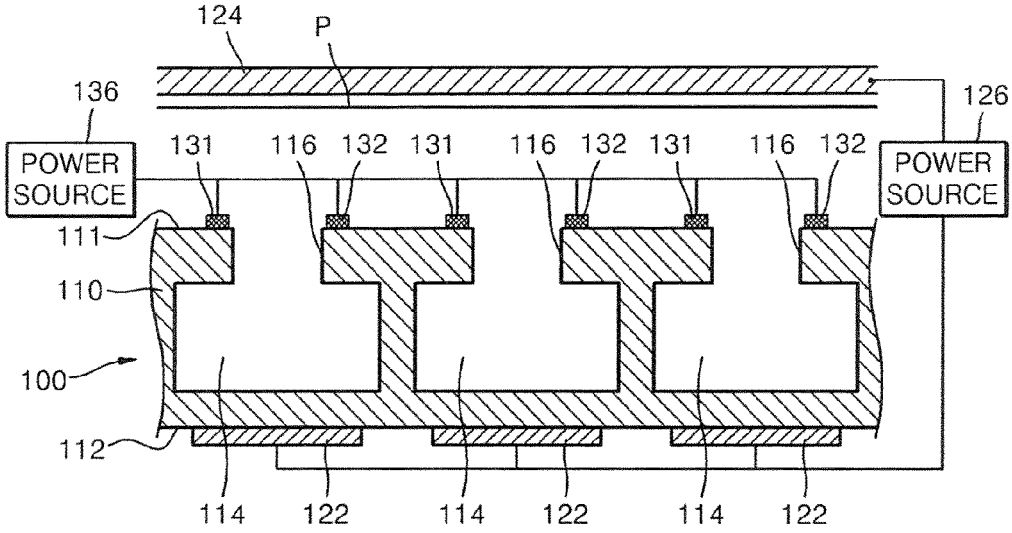
FIG. 1 is a cross-sectional view illustrating an inkjet printing apparatus, according to an embodiment.

Several embodiments will now be described more fully with reference to the accompanying drawings. The disclosure may, however, need not be construed as being limited to the embodiments set forth herein. Rather, these embodiments are provided so that this disclosure will be thorough and complete, and fully conveyed the concept those skilled in the art. Like reference numerals in the drawings denote like elements, and the size of the elements may be exaggerated for clarity of description.

Figure 2:
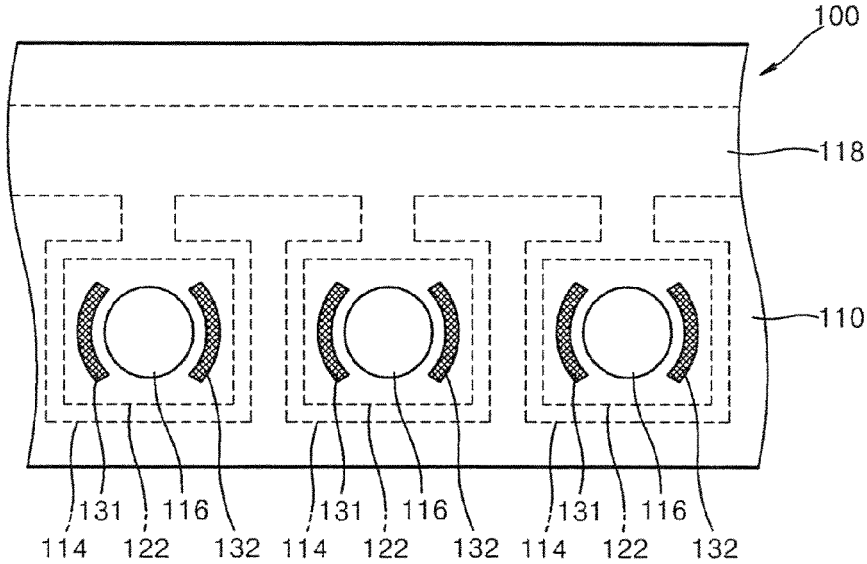
FIG. 2 is a plan view illustrating the inkjet printhead of FIG. 1.

FIG. 1 is a cross-sectional view illustrating an inkjet printing apparatus according to an embodiment, and FIG. 2 is a plan view illustrating the inkjet printhead of FIG. 1. Referring to FIGS. 1 and 2, the inkjet printing apparatus, according to one embodiment, uses an ink ejection method that is based on the application of an electrostatic force. The inkjet printing apparatus includes an inkjet printhead 100 that is configured to eject ink droplets, an electrostatic-force-application unit that provides a driving force to facilitate the ejection of ink droplets from the inkjet printhead 100, and a deflection unit that is configured to deflect or steer a trajectory associated with the inkjet droplets when ejected from the inkjet printhead 100.

As shown in FIG. 1, the inkjet printhead 100 includes a passage plate 110 having multiple ink chambers 114 that are configured to contain or hold ink and multiple nozzles 116 that are configured to eject ink droplets. The passage plate 110 includes a first surface 111 and a second surface 112 opposite the first surface 111. The nozzles 116 are arranged or configured in one or more rows on the first surface 111 of the passage plate 110. The chambers 114 are defined within the passage plate 110 and each of the chambers 114 has a corresponding nozzle 116. One or more ink supply paths 118 are defined within the passage plate 110 and are configured to for supply ink to the ink chambers 114.

The passage plate 110 can include one or more substrates. The substrates used in the passage plate 110 can be substrates on which precise patterning or processing techniques can be applied such as, for example, silicon-based substrates. As will be described below, a silicon-based substrate can be used when infrared laser beams are used to heat up the ink and it is desirable for the substrate to be substantially transparent (e.g., transmissive) to the frequencies associated with the infrared radiation of the laser beams, for example.

The electrostatic-force-application unit of the inkjet printing apparatus is used to facilitate or aide in the ink ejection process. The electrostatic-force-application unit can include multiple first electrodes 122 on the passage plate 110 of the inkjet printhead 100, a second electrodes 124 that is separated from the first surface 111 of the passage plate 110 by a distance and is configured to face or oppose the first surface 111, and a power source 126 that is connected to the first electrodes 122 and to the second electrode 124. The first electrodes 122 can be made or disposed on the second surface 112 of the passage plate 110 and each of the first electrodes 122 can be made to correspond to one of the nozzles 116. An electrostatic field can be established between the first electrodes 122 and the second electrode 124 by applying a voltage difference between the first electrodes 122 and the second electrode 124 through the power source 126. Thus, the electrostatic field presence creates an electrostatic force that is applied to the ink in the ink chambers 114 and the ejection of ink droplets is facilitated or aided by the electrostatic force. When a voltage is applied to one or more of the first electrodes 122, ink droplets can be ejected from the nozzles 116 that correspond to the first electrodes 122 on which a voltage was applied (i.e., a voltage difference with respect to the second electrode 124).

A deflection unit is configured to deflect or steer ink droplets ejected from the inkjet printhead 100 and can include a heating unit configured to heat ink in the ink chambers 114 and an electrostatic-force-application unit. In some embodiments, the electrostatic-force-application unit of the deflection unit can be integrated with the electrostatic-force-application unit of the inkjet apparatus that is configured to facilitate or aide in the ejection of ink droplets.

The heating unit of the deflection unit can include one or more heaters 131 and one or more heaters 132 to heat a portion of the ink in the nozzles 116. The heaters 131 and 132 are disposed around or about each of the nozzles 116 and on the first surface 111 of the passage plate 110. The heating unit of the deflection unit further includes a power source 136 that is configured to drive the heaters 131 and 132. The heaters 131 and 132 in the heating unit can include heating elements (e.g., heat resistors) such as tantalum aluminum (TaAl) or tantalum nitride (TaN). In some embodiments, two or more of the heaters 131 and 132 can be arranged around each of the nozzles 116. For example, a heater 131 and a heater 132 can each be disposed at one side of the nozzle 116 in such a manner as to face or oppose each other. Moreover, the heaters 131 and 132 can have an arc-like shape, for example (see FIG. 2). Each of the heaters 131 and 132 disposed around a nozzle 116 can be driven independently by the power source 136 such that either the heater 131 or the heater 132 heats up a portion of the ink in the nozzle 116. By heating a portion of the ink in the nozzle 116, the surface tension of the heated portion of the ink inside the nozzle 116 can be varied and the trajectory or direction of the ink droplets that are ejected from the nozzle 116 can be deflected as a result of the change in surface tension and the deflection is controlled by the manner in which heat is applied by the heater 131 and/or the heater 132.

Figure 3:
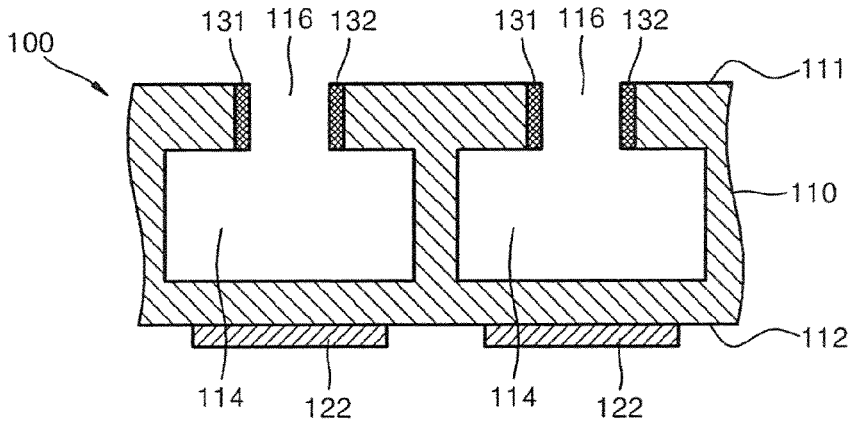
FIG. 3 is a cross-sectional view showing an example in which the position of a heater in the inkjet printhead is different from that shown in FIGS. 1 and 2.

FIG. 3 is a cross-sectional view showing an example in which the position of a heater in an inkjet printhead is different from the position of the heater as shown in FIGS. 1 and 2. As illustrated in FIG. 3, the heaters 131 and 132 can be formed inside the nozzle 116 instead of on the first surface 111 of the passage plate 110. For example, the heater 131 and the heater 132 can be made or disposed to cover a portion of a surface of the nozzle 116 associated with a passage or path through which the ink from the ink chamber 114 associated with that nozzle 116 passes through before being ejected.

Figure 4:
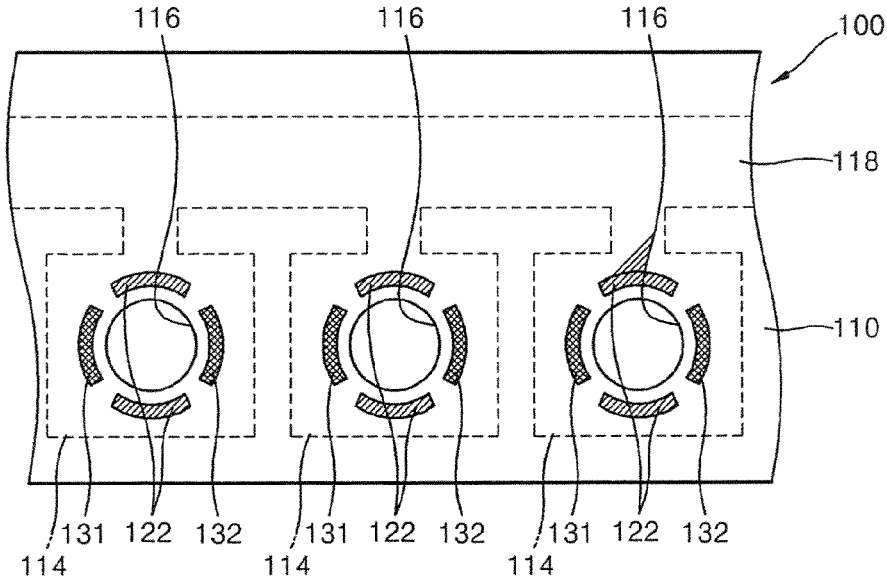
FIG. 4 is a plan view showing an example in which the position of a first electrode in the inkjet printhead is different from that shown in FIGS. 1 and 2.

FIG. 4 is a plan view showing an example in which the position of a first electrode in an inkjet printhead is different from the position of the first electrode as shown in FIGS. 1 and 2. As illustrated in FIG. 4, the first electrodes 122 can be disposed on the first surface 111 instead of on the second surface 112 of the passage plate 110 as shown in the embodiment described above with respect to FIGS. 1 and 2. In the current embodiment, however, a heater 131 and a heater 132 can each be disposed at either side of the nozzle 116 such that the heaters 131 and 132 face or oppose each other. Moreover, two of the first electrodes 122 can be disposed around each of the nozzles 116 such that the first electrodes 122 face or oppose each other and are located between the heater 131 and the heater 132, as illustrated in FIG. 4.

Figure 5:
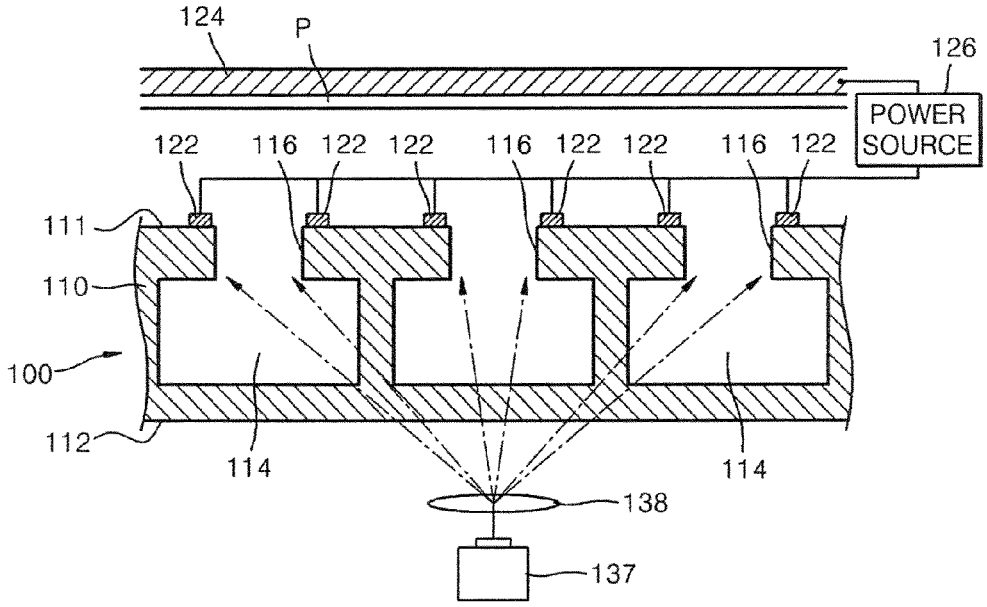
FIG. 5 is a cross-sectional view showing an example in which the position of the first electrode and a heating unit in the inkjet printing apparatus is different from that shown in FIG. 1.

FIG. 5 is a cross-sectional view showing an example in which the position of the first electrode and a heating unit is different from that shown in the inkjet printing apparatus of FIG. 1. Referring to FIG. 5, the heating unit that is used for the deflection of ink droplets can include a laser source, such as a laser diode 137, for example. The laser diode 137 can be configured to emit or produce a laser beam (e.g., infrared (IR) laser beam) that is used for heating the ink instead of using the heaters 131 and 132 described above. The passage plate 110 can be made of a silicon substrate that is substantially transparent to electromagnetic radiation at the frequencies associated with the laser beam produced by the laser diode 137. The laser beam produced by the laser diode 137 can be used to heat the ink inside the nozzle 116 by directing the laser beam to the nozzle 116. The surface tension of the heated portion of the ink in the nozzle 116 is changed when irradiated with energy from the laser beam. A scanner 138 can be disposed in front of the laser diode 137 to scan the laser beam produced by the laser diode 137 to a desirable location in any one of the multiple nozzles 116 such that a single laser diode 137 can be used to heat up ink in any one nozzle 116. In another embodiment, multiple laser diodes 137 can be used. In such embodiment, each of the multiple laser diodes 137 can be associated with one of the multiple nozzles 116 to provide a laser beam to that one nozzle 116 such that a scanner 138 need not be used.

In another embodiment, the laser diode 137 can be disposed outside the inkjet printhead 100 and near the second surface 112 of the passage plate 110. In this embodiment, the first electrodes 122 can be disposed on the first surface 111 of the passage plate 110 around each of the nozzles 116 to allow the laser beam to reach the nozzles 116 without the laser beam being blocked by the first electrodes 122. In this embodiment, the first electrodes 122 can have a ring-like shape, for example.

Figure 6:
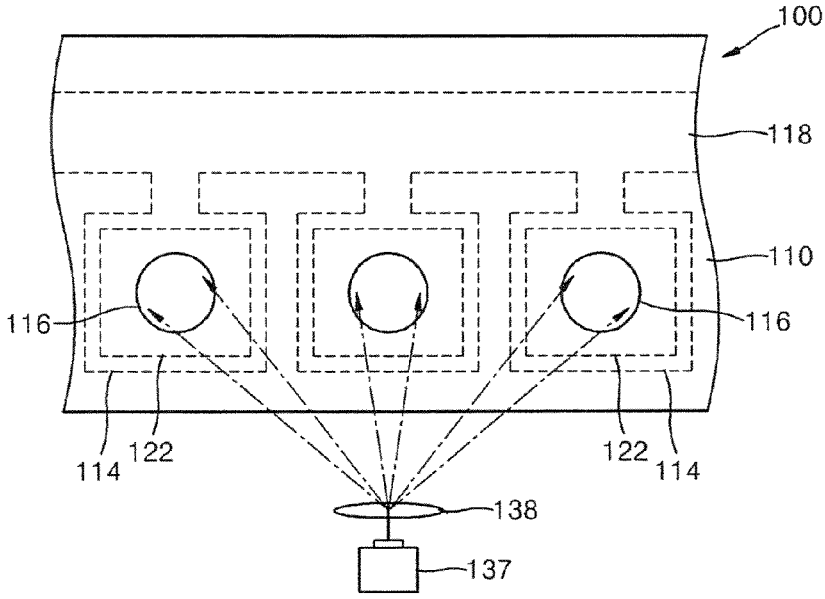
FIG. 6 is a plan view illustrating an example in which a heating unit is different from that shown in the inkjet printing apparatus of FIG. 1.

FIG. 6 is a plan view illustrating an example in which the heating unit is different from the heating unit shown in the inkjet printing apparatus of FIG. 1. Referring to FIG. 6, the first electrodes 122 can be disposed on the second surface 112 of the passage plate 110 as illustrated in FIG. 1 such that the laser diode 137 and the scanner 138 can be disposed to one side of the passage plate 110. In such embodiment, the laser beam emitted by the laser diode 137 and directed by the scanner 138 is not blocked by the first electrodes 122.

Figure 7A:
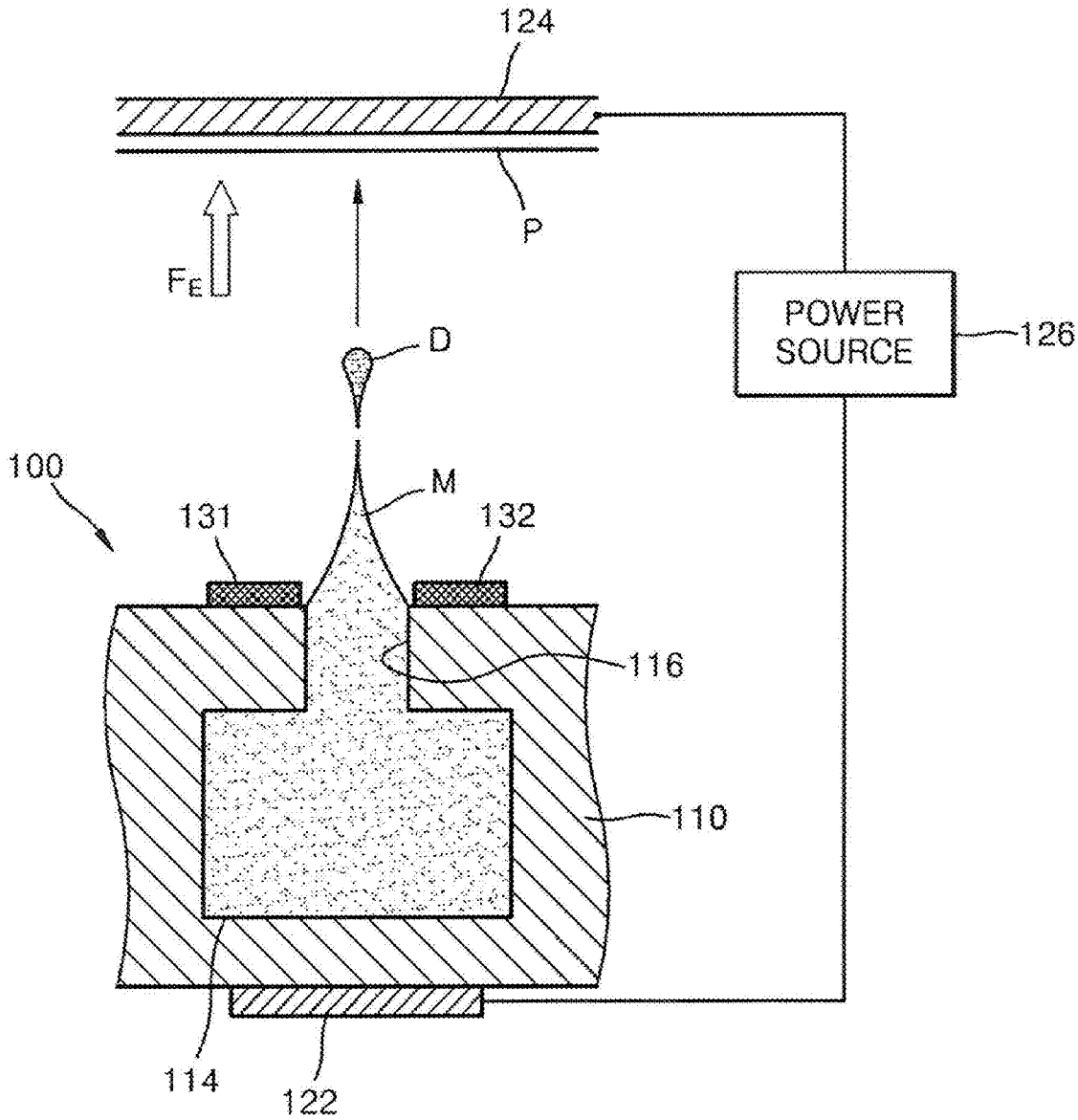
FIGS. 7A-7C are schematic views that illustrate a method of ejecting ink droplets in a deflected fashion using the inkjet printing apparatus of FIG. 1.
Figure 7B:
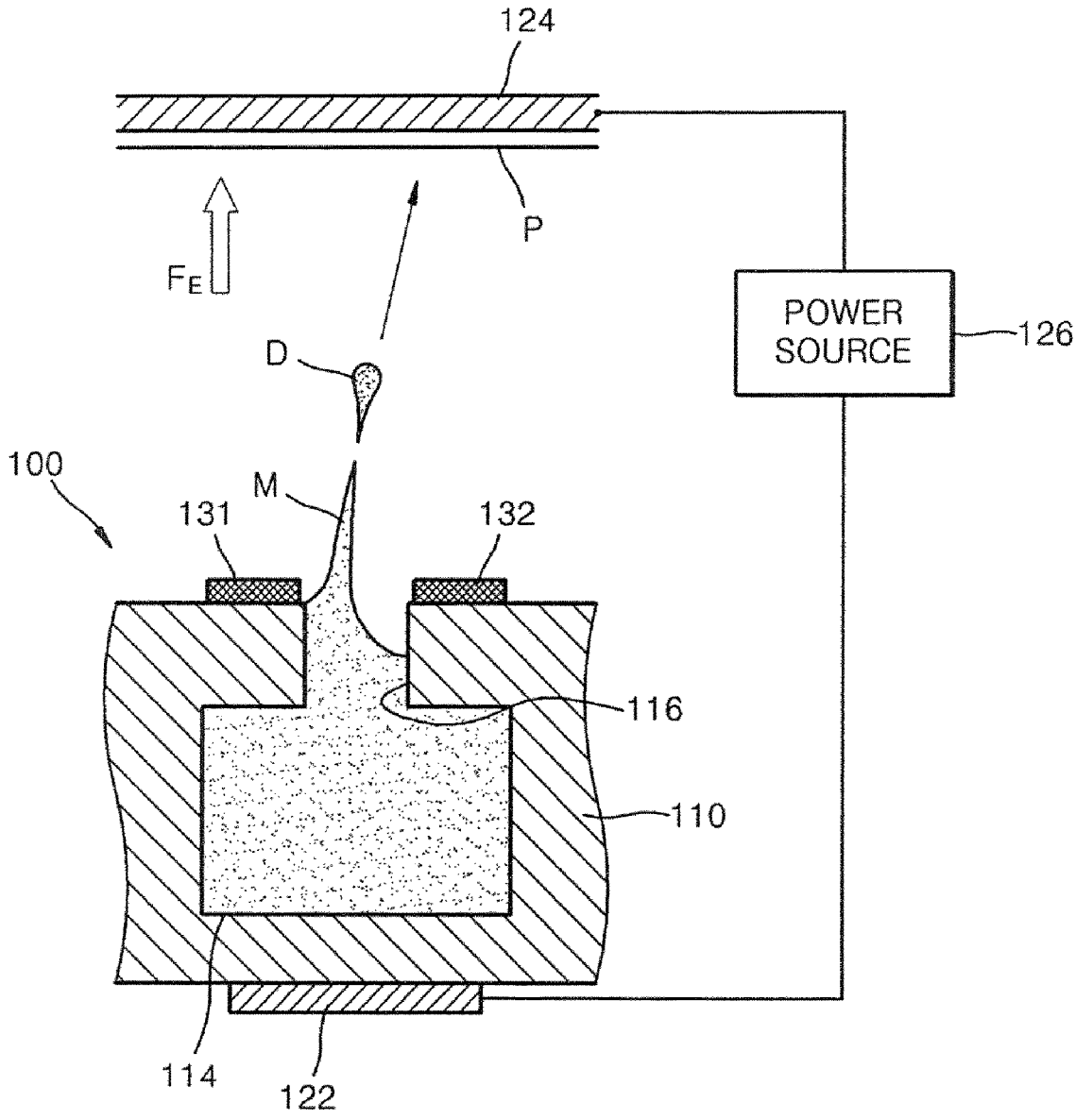
Figure 7C:
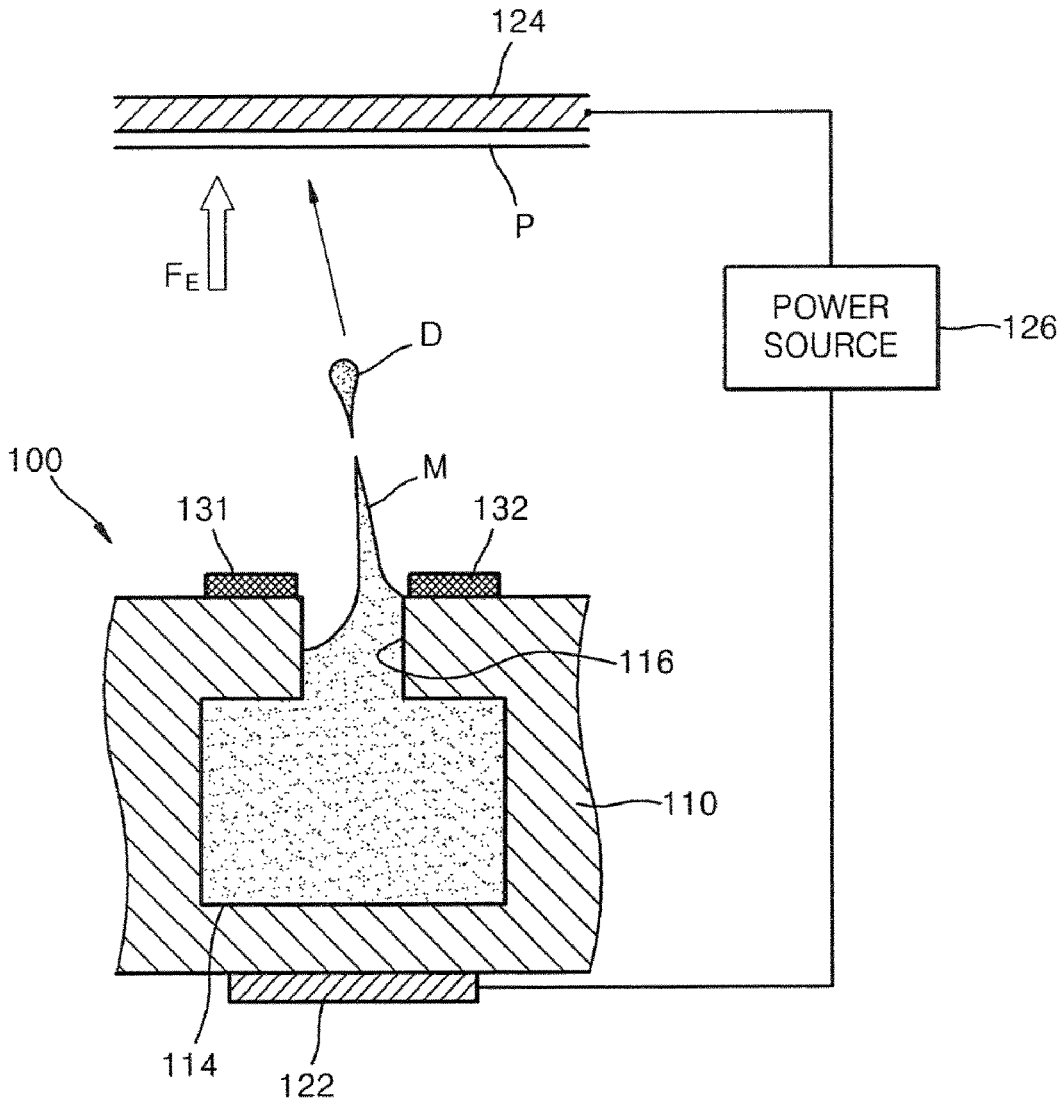

FIGS. 7A-7C are schematic views that illustrate a method of ejecting ink droplets in which the ink droplets are deflected from a typical trajectory by using an inkjet printing apparatus according to any of the embodiment above. Referring to FIG. 7A, when no current is applied to the heaters 131 and 132 that are disposed around the nozzle 116, the temperature of the ink inside the nozzle 116 is substantially uniform or constant. In this instance, an electrostatic force, $F_E$, generated by the electrostatic field that is established between the first electrode 122 and the second electrode 124, is exerted on the ink inside the nozzle 116. The strength and direction of the electrostatic force, $F_E$, is such that ink from the nozzle 116 is pulled in the direction of the second electrode 124 and forms a meniscus M having a symmetrical taylor-cone shape. When the electrostatic force, $F_E$, exceeds the surface tension and viscosity of the ink, the force is sufficient to pull ink from the nozzle 126 and form ink droplets D that travel in the direction of the second electrode 124 until the ink droplets D arrive at the printing medium (e.g., paper) P that is placed in front of the second electrode 124.

Referring to FIG. 7B, when current is applied to the heater 132 on one side of the nozzle 116 but no current is applied to the heater 131 on the opposite side of the nozzle 116, heat is generated by the heater 132, thereby increasing the temperature of the portion of the ink inside the nozzle 116 that is near the heater 132. As a result, the surface tension of the portion of the ink that is heated by the heater 132 is reduced and the ink inside the nozzle 116 that is heated flows in the direction of the ink inside the nozzle 116 that is not heated as, that is, from right to left in FIG. 7B. A temperature difference between, for example, the portion of the ink inside the nozzle 116 that is heated and the portion that is not heated can be about 10 degrees Celsius (° C.) or more. In some embodiments, a temperature difference of about 20° C. can be preferable to generate the above-described fluid flow.

The surface tension of a fluid (e.g., ink) is typically a function of temperature. Thus, when a temperature difference results on a free surface of a fluid that is in contact with air, the surface tension of the fluid tends to be lower in the portion of the fluid surface having the higher temperature than the surface tension in the portion of the fluid surface having the lower temperature. The fluid flow described above results because the gradation in surface tension makes the portion of the fluid at the higher temperature flow in the direction of the portion of the fluid at the lower temperature. This type of fluid flow is typically referred to as Marangoni convection.

As described above, when the ink inside the nozzle 116 flows from, for example, the right portion of the nozzle 116 to the left portion of the nozzle 116 by Marangoni convection, a front end of the meniscus M is sloped down to the right as illustrated in FIG. 7B. As a result, the ink droplets D that are ejected from the nozzle 116 are deflected such that the ink droplets D have a trajectory that is in a direction non-perpendicular to a plane associated with the printing medium P. That is, the ink droplets D are deflected from a typical trajectory that is perpendicular to the plane associated with the printing medium P.

Referring to FIG. 7C, when a current is applied to the heater 131 on one side of the nozzle 116 but no current is applied to the heater 132 on the opposite side of the nozzle 116, heat is generated by the heater 131, thereby increasing the temperature of the portion of the ink inside the nozzle 116 that is near the heater 131. As a result, the surface tension of the portion of the ink that is heated is reduced and the heated ink flows from, for example, the left portion of the nozzle 116 to the right portion of the nozzle 116 by Marangoni convection. Thus, a front end of the meniscus M is sloped down to the left and the ink droplets D that are ejected from the nozzle 116 are deflected to the left of the nozzle 116 and have a trajectory that is in a direction non-perpendicular to a plane associated with the printing medium P.

As described above, when the heaters 131 and 132 are selectively driven, the ink droplets D that are ejected through the nozzle 116 can be deflected from a trajectory that is perpendicular to the printing medium P to a trajectory that is offset to the left or to the right of the perpendicular trajectory.

As illustrated above with respect to FIGS. 5 and 6, the ink droplets D can be deflected in the manner described above with respect to FIGS. 7A-7C when portion of the ink inside the nozzle 116 are heated using a laser beam emitted by, for example, the laser diode 137, instead of being heated by using the heaters 131 and 132.

Figure 8:
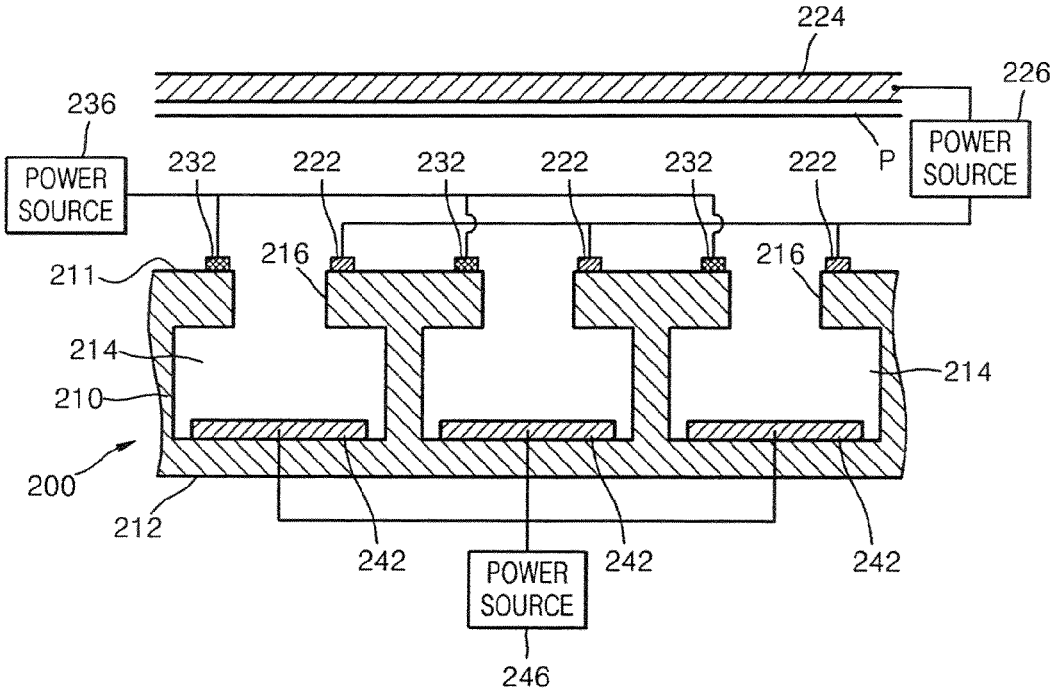
FIG. 8 is a cross-sectional view illustrating an inkjet printing apparatus, according to another embodiment.
Figure 9:
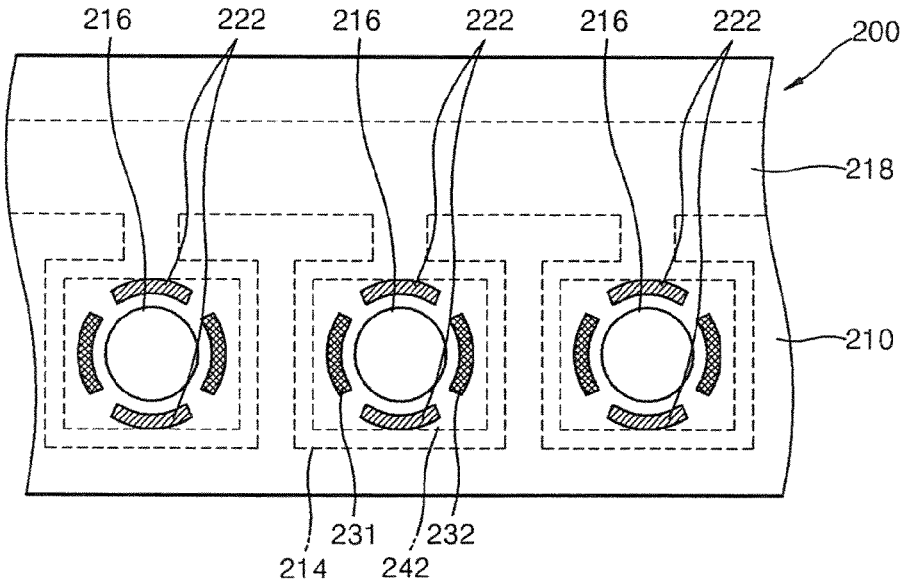
FIG. 9 is a plan view illustrating the inkjet printhead of FIG. 8.

FIG. 8 is a cross-sectional view illustrating an inkjet printing apparatus according to another embodiment, and FIG. 9 is a plan view illustrating the inkjet printhead of FIG. 8. Referring to FIGS. 8 and 9, the inkjet printing apparatus can be configured to use a thermal driving method. The inkjet printing apparatus can include an inkjet printhead 200, a heater 242, and a deflection unit. The inkjet printhead 200 can be configured to eject ink droplets. The heater 242 can be used as, for example, an ink ejecting unit configured to provide a driving force to eject ink droplets from the inkjet printhead 200. The deflection unit can be configured to deflect ink droplets ejected from the inkjet printhead 200.

The inkjet printhead 200 includes a passage plate 210 having multiple ink chambers 214 and multiple nozzles 216. Each of the ink chambers 214 is configured to hold, store, or contain ink. Each of the nozzles 216 is configured to eject ink droplets from ink contained in an associated ink chamber 214. An ink supply path 218 configured to supply ink to the ink chambers 214 can be made or defined inside the passage plate 210. The configuration of the above-described passage plate 210 can be similar to that of the passage plate 110 described above with respect to several embodiments and thus a detailed description of the passage plate 210 can be omitted.

The heater 242 is configured to facilitate or aide in the ejection of ink, thus the heater 242 can referred to as an ejection heater 242. The ejection heater 242 can be made on a bottom surface of the space or volume of an associated ink chamber 214. The power source 246 is connected to the ejection heater 242 and can be used to supply a current to the ejection heater 242. When a current is applied to the ejection heater 242 by the power source 246, the ink inside the ink chamber 214 is heated, producing ink bubbles as a result. The ink droplets are ejected from the nozzle 216 as a result of the expansion of the ink bubbles and the subsequent bursting of the ink bubbles.

A deflection unit that is configured to deflect the ink droplets that are ejected from the inkjet printhead 200 can include a heating unit that is configured to heat the ink in an associated ink chamber 214 and an electrostatic-force-application unit. The heating unit can include one or more heaters 231 and 232 that are disposed around the nozzles 216 and on a first surface 211 of the passage plate 210, as shown in FIG. 9. The heaters 231 and 232 can be referred to as deflection heaters 231 and 232, respectively. The heating unit can further include a power source 236 that is configured to drive (e.g., provide or apply a current) to the deflection heaters 231 and 232. The configuration and/or operation of the deflection heaters 231 and 232 can be similar to the configuration and/or operation of the heaters 131 and 132 described above with respect to several embodiments and thus a further description of the deflection heaters 231 and 232 can be omitted.

The electrostatic-force-application unit of the deflection unit can include multiple first electrodes 222, a second electrode 224, and a power source 226. The multiple first electrodes 22 can be disposed on the passage plate 210 of the inkjet printhead 200. The second electrode 224 can be separate or offset from the first surface 211 of the passage plate 210 by a predetermined distance and can face or oppose the first surface 211. The power source 226 can be connected to the first electrodes 222 and to the second electrode 224. The first electrodes 222 can be disposed around each of the nozzles 216 on the first surface 212 of the passage plate 210 as shown in FIG. 9. In this embodiment, a deflection heater 231 and a deflection heater 232 are disposed at either side of the nozzle 216 such that the deflection heaters 231 and 232 face or oppose each other. Each of two first electrodes 222 can be disposed around each of the nozzles 216 such that the two first electrodes 222 face or oppose each and are located between the deflection heater 231 and the deflection heater 232, also shown in FIG. 9.

An electrostatic field can be established between one or more of the first electrodes 222 and the second electrode 224 by a voltage applied by the power source 226. The electrostatic field produced in this manner results in an electrostatic force that is applied to the ink inside an ink chamber 214. The ink inside the ink chamber 214 can be ejected as ink droplets through the nozzle 216 as a result of the electrostatic force produced by the electrostatic field. By applying an electrostatic force to the ink and selectively driving (e.g., applying a current) the deflection heaters 231 and 232 as illustrated in FIGS. 7A through 7C, the ink droplets D that are ejected through the nozzle 216 can be deflected by a Marangoni convection produced by selectively applying a current to one of the deflection heaters 231 and 232.

Figure 10:
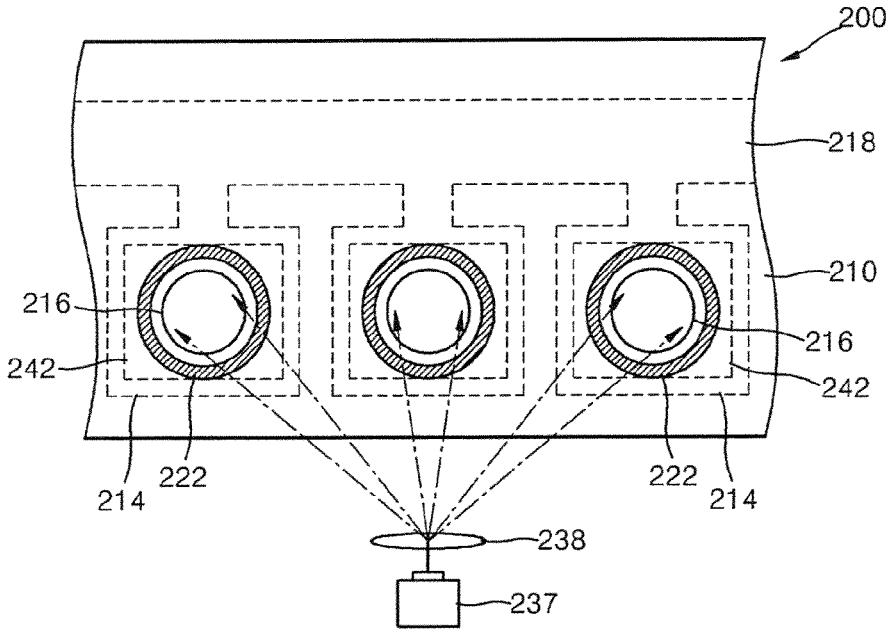
FIG. 10 is a plan view showing an example in which a heating unit is different from that shown in the inkjet printing apparatus of FIG. 8.

FIG. 10 is a plan view showing an example in which a heating unit is different from the heating unit that is shown in the inkjet printing apparatus of FIG. 8. Referring to FIG. 10, the heating unit can include a laser source, such as a laser diode 237, which is configured to emit a laser beam (e.g., IR beam). The laser diode 237 can be used instead of the above-described deflection heaters 231 and 232 for heating ink inside the nozzles 216. The passage plate 210 can be made of a silicon substrate that is transparent to the infrared radiation associated with laser beam produced by the laser diode 237. The energy associated with the laser beam produced by the laser diode 237 heats up a portion of the ink inside the nozzle 216 such that the \surface tension of the heated portion of the ink is changed. A scanner 238 can be disposed in front of the laser diode 237 to deflect or steer the laser beam to a desirable location inside a particular nozzle 216. In another embodiment, a laser diode 237 can be provided for each nozzle 216 from the multiple nozzles 216 such that the scanner 238 need not be used.

In another embodiment, the laser diode 237 can be disposed at a side of the passage plate 210, as illustrated in FIG. 10. In such embodiment, the laser beam that is emitted by the laser diode 237 may not be blocked by the ejection heater 242. In such embodiment, the first electrodes 222 can have a ring-like shape, for example.

Figure 11:
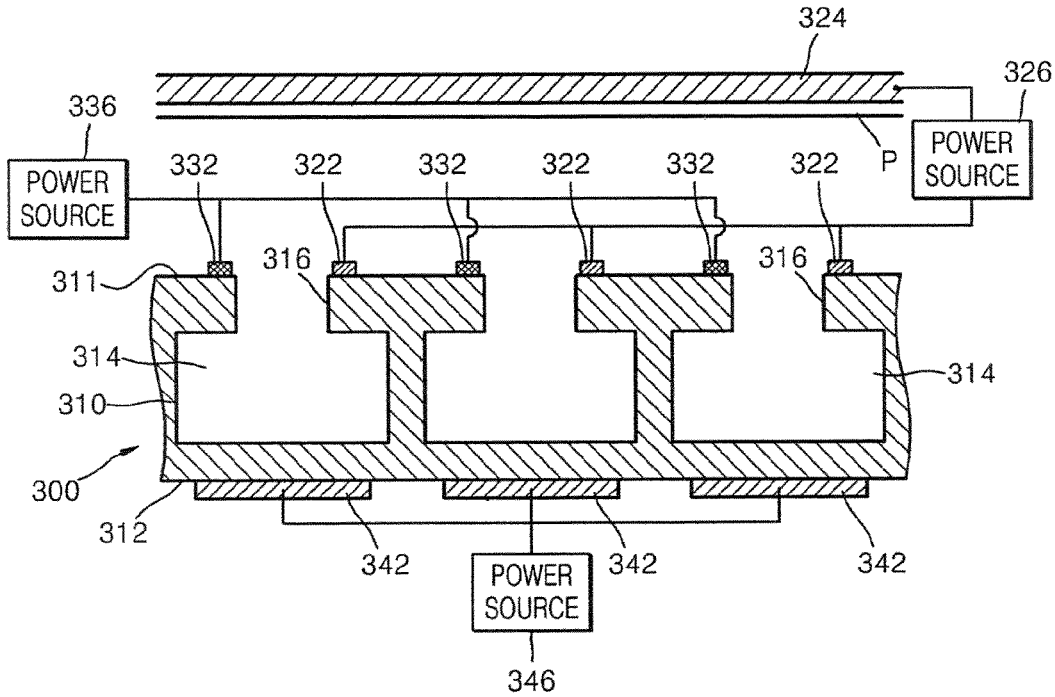
FIG. 11 is a cross-sectional view illustrating an inkjet printing apparatus, according to another embodiment.
Figure 12:
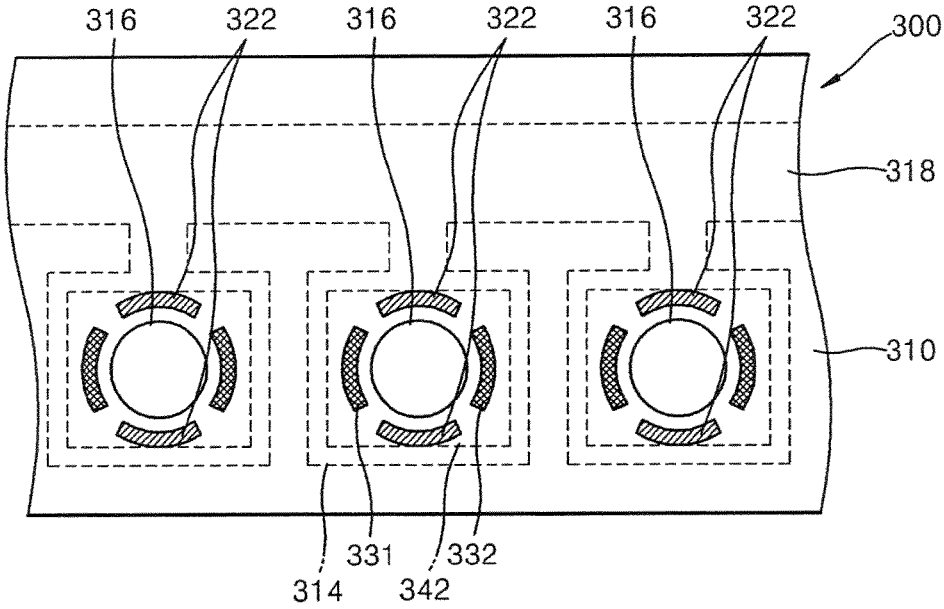
FIG. 12 is a plan view illustrating the inkjet printhead of FIG. 11.

FIG. 11 is a cross-sectional view illustrating an inkjet printing apparatus according to another embodiment, and FIG. 12 is a plan view illustrating the inkjet printhead of FIG. 11. Referring to FIGS. 11 and 12, the inkjet printing apparatus can be configured to use a piezoelectric driving method. The inkjet printing apparatus can include an inkjet printhead 300 that is configured to eject ink droplets, a piezoelectric actuator 342 that is configured to facilitate or aide in the ejection of ink droplets by providing a driving force to eject the ink droplets from the inkjet printhead 300, and a deflection unit that is configured to deflect the ink droplets that are ejected from the inkjet printhead 300.

The inkjet printhead 300 includes a passage plate 310 having multiple ink chambers 314 and multiple nozzles 316. Each of the ink chambers 314 is configured to contain or hold ink. Each of the nozzles 316 is configured to eject ink droplets from ink that is contained in an associated ink chamber 314. The passage plate 310 can further include an ink supply path 318 that is configured to supply ink to the ink chambers 314. The configuration of the passage plate 310 is the same as that of the above-described embodiments, and thus detailed description thereof will be omitted.

The piezoelectric actuator 342 can be disposed on a second surface 312 of the passage plate 310. A piezoelectric actuator 342 can be disposed for each of the nozzles 316. A power source 346 can be connected to the piezoelectric actuator 342 to apply a voltage to the piezoelectric actuator 342. A voltage applied to the piezoelectric actuator 342 physically deforms the piezoelectric actuator 342 and that deformation is such that a pressure is applied to the ink inside the ink chamber 314. The ink droplets that are ejected from the nozzle 316 are ejected, at least partially, because of the pressure applied on the ink by the deformation produced on the piezoelectric actuator 342 by the applied voltage.

A deflection unit of the inkjet printhead 300 may include a heating unit and/or an electrostatic-force-application unit. The heating unit can include heaters 331 and 332 that are disposed around each of the nozzles 316 on a first surface 311 of the passage plate 310. The heaters 331 and 332 can be referred to as deflection heaters 331 and 332, respectively. The heating unit can further include a power 336 that is configured to drive (e.g., provide or apply a current) the deflection heaters 331 and 332. The configuration and/or the function of the deflection heaters 331 and 332 can be similar to the configuration and/or the function of the above-described embodiments and thus a further description of the deflection heaters 331 and 332 can be omitted.

The electrostatic-force-application unit can include multiple first electrodes 322 that are disposed on a surface of the passage plate 310 of the inkjet printhead 300, a second electrode 324 that is separate or offset from the first surface 311 of the passage plate 310 by a predetermined distance and faces or opposes the first surface 311, and a power source 326 that is connected to the first electrodes 322 and to the second electrode 324. The configuration of the first electrodes 322 and the second electrode 324 can be similar to the configuration described above with respect to FIGS. 8 and 9, and thus further description of the first electrodes 322 and the second electrode 324 can be omitted. Moreover, the function of the electrostatic-force-application unit and the function of the heating unit can be similar to those of the embodiments described above with respect to FIGS. 8 and 9, and thus a further description of the electrostatic-force-application unit can be omitted.

Figure 13:
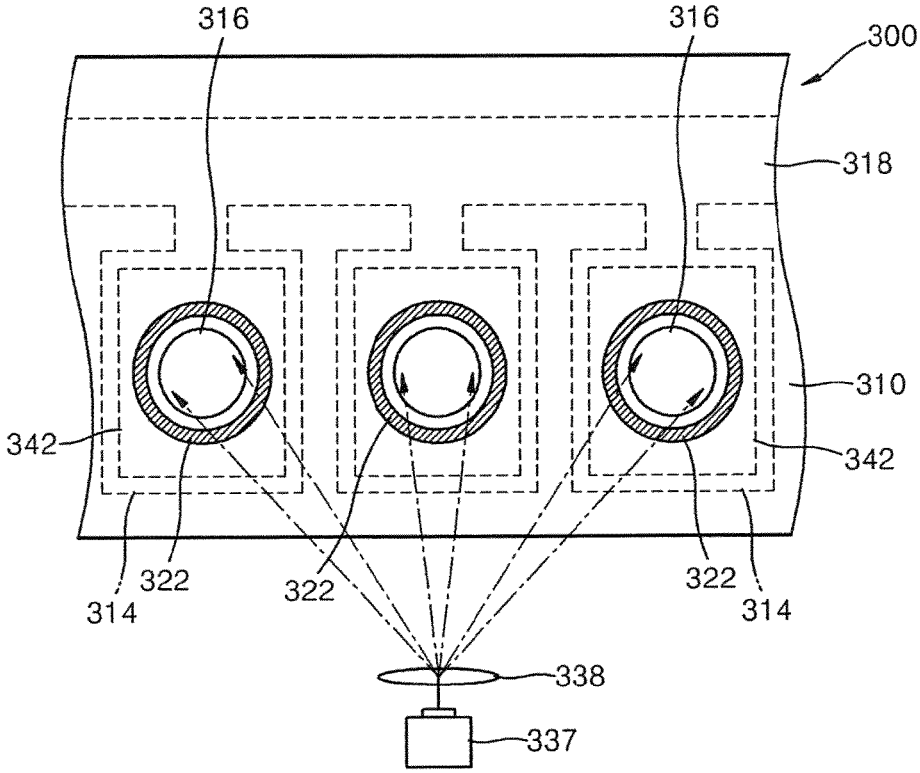
FIG. 13 is a plan view illustrating an example in which a heating unit is different from that shown in the inkjet printing apparatus of FIG. 11.

FIG. 13 is a plan view illustrating an example in which the heating unit is different from the heating unit that is shown in the inkjet printing apparatus of FIG. 11. Referring to FIG. 13, the heating unit that is used to deflect or steer ink droplets can include a laser source, such as a laser diode 337, for example, that is configured to produce or emit a laser beam (e.g., an infrared laser beam). The energy associated with the laser beam produced by the laser diode 337 can be used instead of the above-described deflection heaters 331 and 332 to heat up ink in the ink chambers 314. The passage plate 310 can be made of a silicon substrate that is transparent (e.g., transmissive) to the electromagnetic radiation frequencies associated with the infrared laser beam. The laser diode 337 can partially heat the ink inside each of the nozzles 316 by the energy that is associated with the infrared laser beam to cause the surface tension of the heated portion of the ink to change. A scanner 338 can be disposed in front of the laser diode 337 to deflect the laser beam in the direction of a particular nozzle 316 and in a desirable position within the nozzle 316. In another embodiment, multiple laser diodes 337 can be used and each laser diode 337 is used to heat up ink inside an associated nozzle 316. In this embodiment the scanner 338 may not be needed.

In another embodiment, the laser diode 337 can be disposed at a side of the passage plate 310. In such embodiment, the laser beam emitted from the laser diode 337 is not blocked by the piezoelectric actuator 342. Moreover, each of the first electrodes 322 can have a ring-like shape, for example.

In the embodiments described with respect to FIGS. 1 through 6, an electrostatic-force-application unit can be used to facilitate or ease the ejection of ink during a typical ink ejection operation and a heating unit can be used together with the electrostatic-force-application unit to eject ink in a manner that is deflected or offset from a trajectory that is substantially perpendicular to the printing medium.

Moreover, in the embodiments described with respect to FIGS. 8 through 13, the ejection heater 242 and the piezoelectric actuator 342 can be used to facilitate ink ejection for a typical ejection operation, and the electrostatic-force-application unit can be used to eject ink droplets in a manner that is deflected or offset from a trajectory that is substantially perpendicular to the printing medium. As a result, when a nozzle from the multiple nozzles is unavailable or missing during operation, ink droplets that are ejected through a nozzle adjacent to the missing nozzle can be deflected or redirected to compensate for the missing nozzle by use of the electrostatic-force-application unit together with the heating unit as described above.

When the electrostatic-force-application unit is not used, that is, when ink is ejected by using the ejection heater 242 or the piezoelectric actuator 342, for example, a meniscus having a taylor-cone shape as illustrated in FIGS. 7A through 7C may not be formed. Therefore, it is preferable to use an electrostatic force to produce the needed ink droplet deflection that compensates for missing or unavailable nozzles.

As described above, according to the embodiments of the present invention, ink droplets can be ejected through a nozzle and can be deflected or redirected using an electrostatic force and Marangoni convection. Thus, when a nozzle is missing or unavailable because of any of the above-described reasons, or because of any other reason, ink droplets can be ejected through a nozzle adjacent to the left or to the right side of the missing nozzle and the ejected ink droplets can be deflected to print that which could not be printed because of the missing nozzle. Consequently, even when a nozzle is missing during the operation of the inkjet printhead, white bands that would otherwise be typically produced on a printed image because of the malfunctioning nozzle can be prevented and any reduction in the quality of the printed image can be averted or minimized.

While the disclosure has been particularly shown and described with reference to exemplary embodiments thereof, it will be understood by those of ordinary skill in the art that various changes in form and details may be made therein without departing from the spirit and scope of the embodiments as defined by the following claims.

What is claimed is:

1. An inkjet printing apparatus, comprising:

an inkjet printhead including a passage plate and a plurality of ink chambers defined within the passage plate, the passage plate having a surface and a plurality of nozzles on the surface of the passage plate, each ink chamber from the plurality of ink chambers being associated with one nozzle from the plurality of nozzles;

an electrostatic-force-application unit configured to cause ink droplets to eject from each nozzle from the plurality of nozzles by applying an electrostatic force to the ink inside the nozzles; and a heating unit configured to heat a portion of the ink inside any one nozzle from the plurality of nozzles to deflect a direction in which the ink droplets are ejected from the nozzle to which the heat is applied.

2. The inkjet printing apparatus of claim 1, further comprising a plurality of ejection heaters, each ejection heater from the plurality of ejection heaters being configured to heat ink inside an associated ink chamber from the plurality of ink chambers to generate an ink bubble to cause ink droplets to eject through the nozzle associated with that ink chamber.

3. The inkjet printing apparatus of claim 2, wherein each ejection heater from the plurality of ejection heaters is disposed on a bottom surface of the associated ink chamber.

4. The inkjet printing apparatus of claim 1, further comprising a plurality of piezoelectric actuators, each piezoelectric actuator from the plurality of piezoelectric actuators being configured to apply a pressure to ink inside an associated ink chamber from the plurality of ink chambers to cause ink droplets to eject through the nozzle associated with that ink chamber.

5. The inkjet printing apparatus of claim 4, wherein:

the surface of the passage plate is a first surface, the passage plate having a second surface, and the plurality of piezoelectric actuators are disposed on the second surface of the passage plate.

6. The inkjet printing apparatus of claim 1, wherein the passage plate includes a silicone substrate.

7. The inkjet printing apparatus of claim 1, wherein the electrostatic-force-application unit includes a plurality of first electrodes and a second electrode, the plurality of first electrodes being disposed on the passage plate, one or more first electrodes from the plurality of first electrodes being associated with each nozzle from the plurality of nozzles, the second electrode being offset from the surface of the passage plate by a distance.

8. The inkjet printing apparatus of claim 7, wherein the plurality of first electrodes are disposed on the surface of the passage plate, one or more first electrodes from the plurality of first electrodes being disposed around each of the nozzles.

9. The inkjet printing apparatus of claim 7, wherein:

the surface of the passage plate is a first surface, the passage plate having a second surface and the plurality of first electrodes are disposed on the second surface of the passage plate.

10. The inkjet printing apparatus of claim 1, wherein the heating unit includes two or more deflection heaters associated with each of the nozzles and disposed around the associated nozzle.

11. The inkjet printing apparatus of claim 10, wherein the two or more deflection heaters are disposed on the surface of the passage plate and have an arc-like shape.

12. The inkjet printing apparatus of claim 10, wherein the two or more deflection heaters are disposed on an inner surface of the associated nozzle.

13. The inkjet printing apparatus of claim 1, wherein the heating unit includes a laser diode disposed outside the inkjet printhead and configured to produce an infrared laser beam directed at a portion of the ink inside any one nozzle from the plurality of nozzles.

14. The inkjet printing apparatus of claim 13, wherein the heating unit includes a scanner configured to direct the infrared laser beams produced by the laser diode to the portion of the ink inside any one nozzle from the plurality of nozzles.

15. A method of ejecting ink droplets, comprising:

applying an electrostatic force to ink inside one or more nozzles from a plurality of nozzles in an inkjet printhead, the electrostatic force producing a meniscus at a surface of the ink at the one or more nozzles; and varying the surface tension of the ink at the one or more nozzles to which the electrostatic force is applied, the surface tension being varied by applying heat to a portion of the ink at any one nozzle from the one or more nozzles to which the electrostatic force is applied, wherein the meniscus in the nozzle to which heat is applied is deformed by the variation in surface tension that results from the heating and the meniscus deformation is such that ink droplets ejected from that nozzle are deflected.

16. The method of claim 15, wherein the meniscus at the surface of the ink at the one or more nozzles has a taylor-cone shape, and the taylor-cone shape of the meniscus of the nozzle to which heat is applied is inclined by a Marangoni convection that results from the heating.

17. The method of claim 16, wherein the meniscus of the nozzle to which heat is applied is sloped down in the direction of the heated portion of the ink, and the ink droplets ejected from that nozzle are deflected in the direction of the heated portion of the ink.

18. The method of claim 15, wherein a temperature difference in the ink inside the nozzle to which heat is applied between the portion of the ink to which heat is applied and a portion of the ink to which heat is not applied is 10° C. or greater.

19. The method of claim 15, wherein the portion of the ink inside the nozzle to which heat is applied is heated by a heater or by a laser diode emitting an infrared laser beam.

20. The method of claim 19, further comprising scanning the infrared laser beam emitted by the laser diode to a position within the nozzle to which heat is applied.

* * * * *

UNITED STATES PATENT AND TRADEMARK OFFICE

CERTIFICATE OF CORRECTION

PATENT NO. : 8,132,894 B2
APPLICATION NO. : 12/398333
DATED : March 13, 2012
INVENTOR(S) : You-Seop Lee It is certified that error appears in the above-identified patent and that said Letters Patent is hereby corrected as shown below:

Column 12, Line 19, In Claim 9, delete “surface” and insert -- surface, --, therefor.

Signed and Sealed this
Twenty-ninth Day of May, 2012

David J. Kappos

David J. Kappos
*Director of the United States Patent and Trademark Office*